US006802365B2

(12) United States Patent
Huguet et al.

(10) Patent No.: US 6,802,365 B2
(45) Date of Patent: Oct. 12, 2004

(54) METHOD FOR ASSEMBLING THE PLATES OF A PLATE PACK AND RESULTING PLATE PACK

(75) Inventors: Francois Régis Huguet, Epervans (FR); Pierre Tanca, Sainte-Helene (FR); Eric Gilbert-Desvallons, Saint Marcel (FR)

(73) Assignee: Packinox, Courbevoie (FR)

( * ) Notice: Subject to any disclaimer, the term of this patent is extended or adjusted under 35 U.S.C. 154(b) by 7 days.

(21) Appl. No.: 10/204,973

(22) PCT Filed: Feb. 28, 2001

(86) PCT No.: PCT/FR01/00587

§ 371 (c)(1),
(2), (4) Date: Nov. 1, 2002

(87) PCT Pub. No.: WO01/71268

PCT Pub. Date: Sep. 27, 2001

(65) Prior Publication Data

US 2003/0093900 A1 May 22, 2003

(30) Foreign Application Priority Data

Mar. 20, 2000 (FR) ..... 00 03550

(51) Int. Cl.[7] ..... F28F 3/08

(52) U.S. Cl. ..... 165/166; 165/DIG. 384; 29/890.03

(58) Field of Search ..... 165/166, 167, 165/DIG. 382, DIG. 384

(56) References Cited

U.S. PATENT DOCUMENTS

| | | | | |
|---|---|---|---|---|
| 2,959,401 A | * | 11/1960 | Burton | 165/166 |
| 3,274,672 A | | 9/1966 | Dore | |
| 3,719,227 A | * | 3/1973 | Jenssen | 165/166 |
| 4,099,928 A | * | 7/1978 | Norback | 29/890.039 |
| 4,125,153 A | * | 11/1978 | Stoneberg | 165/166 |
| 4,313,494 A | | 2/1982 | Bengtsson | |
| 4,378,837 A | * | 4/1983 | Ospelt | 165/166 |
| 5,638,899 A | * | 6/1997 | Blomgren et al. | 165/166 |
| 6,516,874 B2 | * | 2/2003 | Mathur et al. | 165/166 |

FOREIGN PATENT DOCUMENTS

| | | |
|---|---|---|
| EP | 0566208 A1 | 10/1993 |
| EP | 0828131 A | 3/1998 |
| FR | 584939 | 2/1925 |
| FR | 2318398 | 2/1977 |

OTHER PUBLICATIONS

International Search Report, PCT/FR01/00587, Jun. 12, 2001, pg. 1–2.

* cited by examiner

*Primary Examiner*—Allen J. Flanigan
(74) *Attorney, Agent, or Firm*—Connolly Bove Lodge & Hutz LLP

(57) ABSTRACT

Plates of a heat exchanger plate pack are formed by a stack of plates defining at least two independent fluid flow circuits, each circuit comprising a central heater part and a border with a smooth surface. A cutout is produced on corners of each plate and on the border to be connected, of each plate to the adjacent plate, a fold is made in order to form a first flange. On this first flange a fold is made in order to form a second flange laying parallel to the central part of the corresponding plate and directed outward from the plate. The plates are superposed and held by applying the second flange of each plate to the second flange of the adjacent plate. A continuous sealed weld bead is made by completely melting the second superposed flanges of adjacent plates.

15 Claims, 5 Drawing Sheets

METHOD FOR ASSEMBLING THE PLATES OF A PLATE PACK AND RESULTING PLATE PACK

FIELD OF THE INVENTION

The present invention relates to a method for assembling the plates of a plate pack for a heat exchanger and resulting plate pack.

BACKGROUND OF THE INVENTION

In general, plate packs for a heat exchanger comprise a stack of plates parallel to each other.

The plates, consisting of thin sheet metal, most often made of stainless steel or any other suitable material, comprise borders with a smooth surface and a central heat-exchange part which is usually provided with corrugations by means of which they are in contact with each other and by means of which they define the circuits for flow of at least two independent fluids.

The flow of the fluids between the plates may be of the co-current, counter-current or crossflow type and each circuit is connected to collectors for intake and return of fluids.

Usually, the plates are assembled two by two using connection tabs welded to the borders with a smooth surface in order to form plate pairs and these plate pairs are superposed and assembled together so as to form the plate pack.

The connection tabs are placed at particular locations in order to define inflow and outflow regions allowing the flow of said fluids between the plates.

Hitherto, the plates of each plate pair were assembled as follows.

First of all, at least one tab is positioned at particular locations on the lower face of the borders of the upper plate, then said tab is connected by welding to said plate in order to form a first subassembly.

Next, at least one tab is positioned at particular locations on the upper face of the borders of the lower plate, then said tab is connected by welding to said plate in order to form a second subassembly.

Each weld bead is made along the edge, that is to say that it covers the free ends of the corresponding plate and of the tabs.

Next, the two subassemblies are superposed and held pressed one on the other for example by means of a press. These two subassemblies are connected together by a third weld bead made along the edge, that is to say that it covers the two previous weld beads connecting the plate and the tabs of each subassembly.

The plate pairs thus produced are superposed and a layer of welding is deposited over the entire height of each lateral surface of the plate pack in order to form a wall of sealed weld.

However, this method of assembly has drawbacks.

This is because it requires special tooling and many steps in order to assemble all the plates.

Furthermore, at the time of superposing the plate pairs, alignment defects may occur which create interstices forming sites susceptible to corrosion.

To avoid these defects, another method consists in forming, on the border to be connected of each plate to the adjacent plate, a flange folded at 90° with respect to the central part of the corresponding plate, in superposing the plates by applying the free ends of the flanges one on the other and in making a weld bead over each mating plane with or without filler metal.

However, this assembly method also has drawbacks, the main one of which lies in the fact that bringing the various plates into contact with each other is awkward, given the small thickness of these plates, so that the welding operation is also difficult to carry out.

Furthermore, the weld bead may have defects which may impair the seal of the plate pack given the pressures prevailing inside the circuit.

BRIEF DESCRIPTION OF THE INVENTION

The subject of the invention is therefore a method for assembling the plates of a plate pack for a heat exchanger formed by a stack of plates together defining at least two flow circuits for independent fluids and each comprising a central heat-exchange part and borders with a smooth surface, characterized in that:

- a cutout is produced on the corners of each plate,
- on the border to be connected of each plate to the adjacent plate, a fold is made in order to form a first flange,
- on this first flange, a fold is made in order to form a second flange lying parallel to the central part of the corresponding plate and directed outward from said plate,
- the plates are superposed and held by applying the second flange of each plate to the second flange of the adjacent plate, and
- a continuous sealed weld bead is made by melting the second superposed flanges of adjacent plates.

According to other characteristics of the invention:

- the weld bead is made by complete melting of the second superposed flanges of adjacent plates,
- a closure plate is placed on the upper part and on the lower part, respectively, of the plate stack, and each closure plate is welded by a continuous sealed weld bead to the flange of the adjacent plate
- each side face of the plate stack is partially closed by a covering plate.
- the second flange forms, with the first flange, an angle equal to or different from the angle formed between the first flange and the central part of the corresponding plate and each angle is, for example, between 75 and 105°.

The subject of the invention is also a plate pack for a heat exchanger, characterized in that it comprises plates superposed and assembled by the aforementioned method.

According to other characteristics of the invention:

- each plate has the shape of a quadrilateral comprising a central heat-exchange part and four borders with a smooth surface, each one fitted with a folded flange, the four folded flanges being directed alternately upward and downward,
- the plate pack comprises a closure plate placed on the upper part and on the lower part, respectively, of the plate stack, each closure plate being connected to the flange of the adjacent plate by a continuous sealed weld bead,
- the plate pack comprises a covering plate placed on each side face of the plate stack partially closing the corresponding side face.

BRIEF DESCRIPTION OF THE FIGURES

The invention will be better understood by means of the following description, given by way of example and made with reference to the appended drawings, in which.

DETAILED DESCRIPTION OF THE INVENTION

The method of assembly according to the invention is generally applicable to the plate packs formed by a stack of plates together defining at least two fluid-flow circuits of the cross flow, counter-current or co-current type.

Conventionally, a plate pack of a heat exchanger consists of a stack of plates 1 parallel to each other, each of which consists of thin sheet metal, usually stainless steel or any other sufficiently ductile material.

Figure 1:
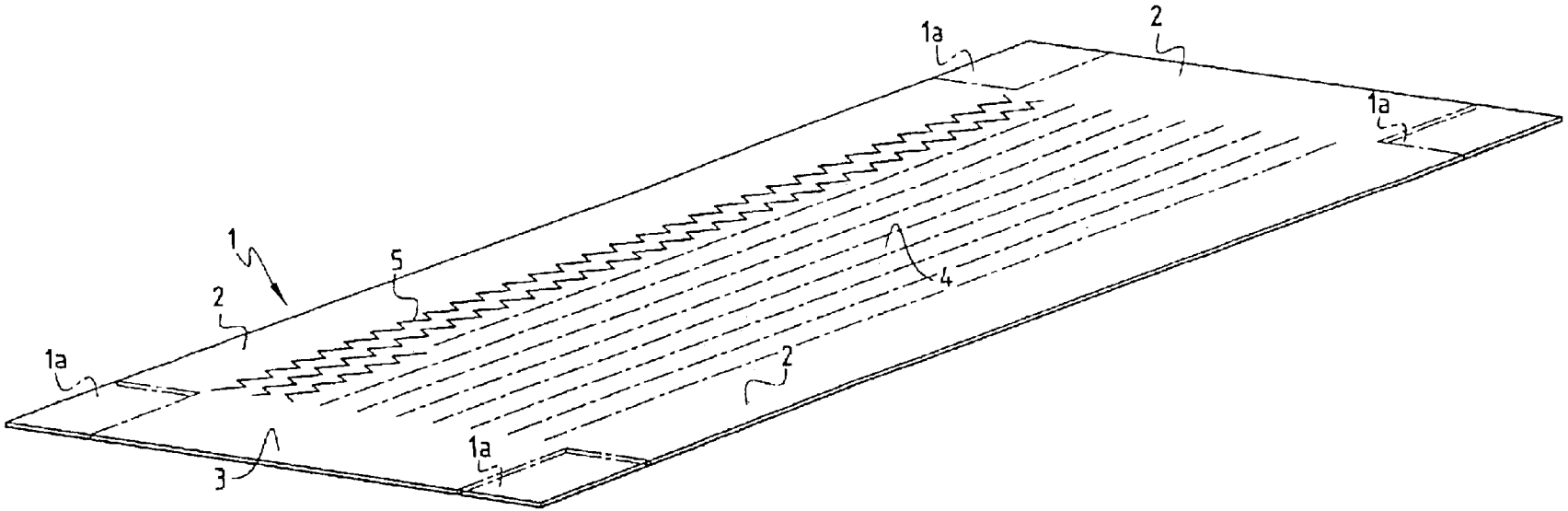
FIG. 1 is a schematic perspective view of one plate of a plate pack.

Thus, as shown in FIG. 1, each plate 1 initially has the shape of a quadrilateral, for example a rectangle or square, comprising longitudinal 2 and transverse 3 borders, respectively, with a smooth surface and a central heat-exchange part 4 provided with corrugations by means of which they are in contact with each other and by means of which they define the flow circuits for at least two independent fluids.

In general, the method of assembling plates 1 in order to form a plate pack consists:

- in providing a cutout on the corners of each plate,
- in producing on the border to be connected of each plate to the adjacent plate, a fold in order to form a first flange,
- in producing on this first flange a fold in order to form a second flange,
- in superposing and holding the plates by applying the second flange of each plate to the second flange of the adjacent plate, and
- in producing, with or without filler metal, a continuous sealed weld bead by melting the second superposed flanges of the adjacent plates.

Preferably, the weld bead 15 is produced by complete melting of the second superposed flanges 11 and 13 of the adjacent plates 1.

The method of assembly first of all consists in producing a cutout 1*a* on the corners of each plate 1, as shown in FIG. 1.

Next, a fold 6 is produced on each longitudinal border 2 in order to form a first flange 7 and the same operation is carried out on each transverse border 3 in order to produce a fold 8 so as to form a first flange 9.

Figure 2:
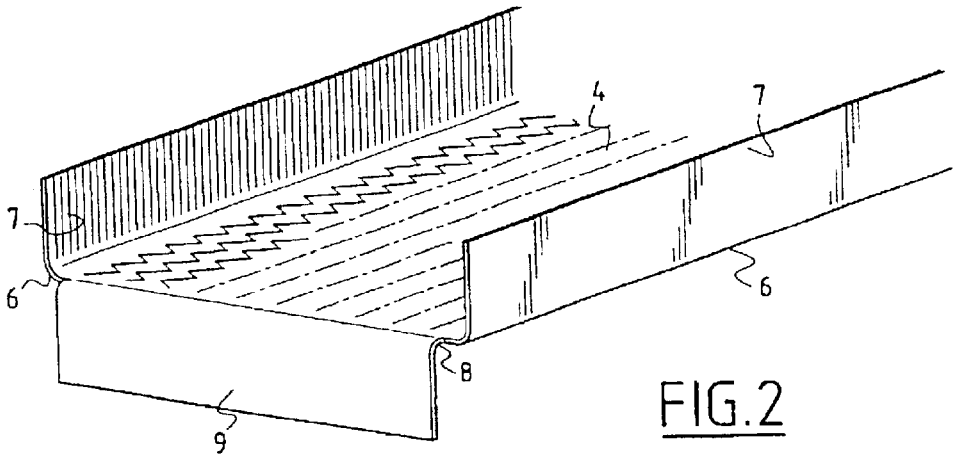
FIGS. 2 to 6 are schematic perspective views showing the various steps of the method of assembly according to the invention.

The four first flanges 7 and 9 are alternately directed upward and downward, as shown in FIG. 2.

Next, on the first flange 7 of each longitudinal border 2, a fold 10 is produced in order to form a second flange 11 lying parallel to the central part 4 of the plate 1. This second flange 11 is directed outward from said plate 1.

Likewise, on the first flange 9 of each transverse border 3, a fold 12 is produced in order to form a second flange 13 lying parallel to the central part 4 of the plate 1.

Figure 3:
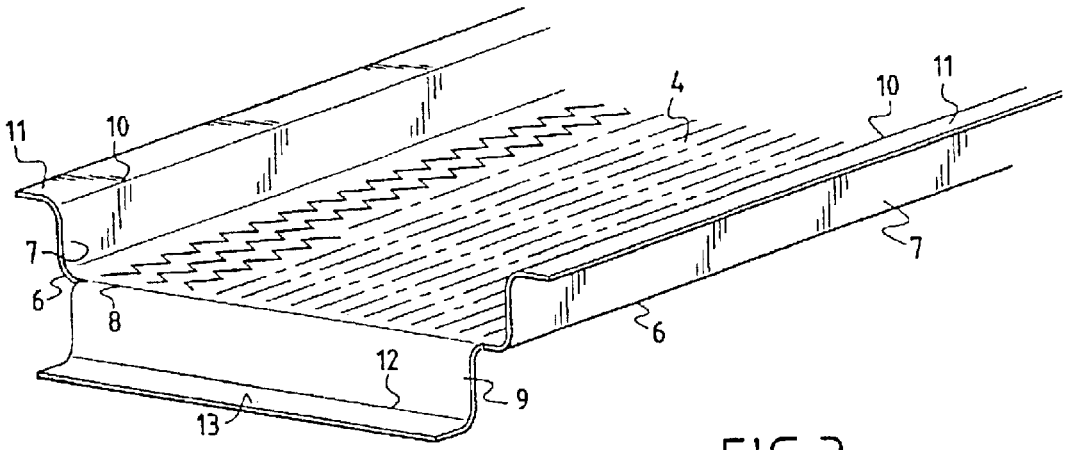

This second flange 13 is also directed outward from said plate 1, as shown in FIG. 3.

The first and second flanges 7, 9 and 11, 13, respectively, are effected by means of a conventional folding press.

Figure 4:
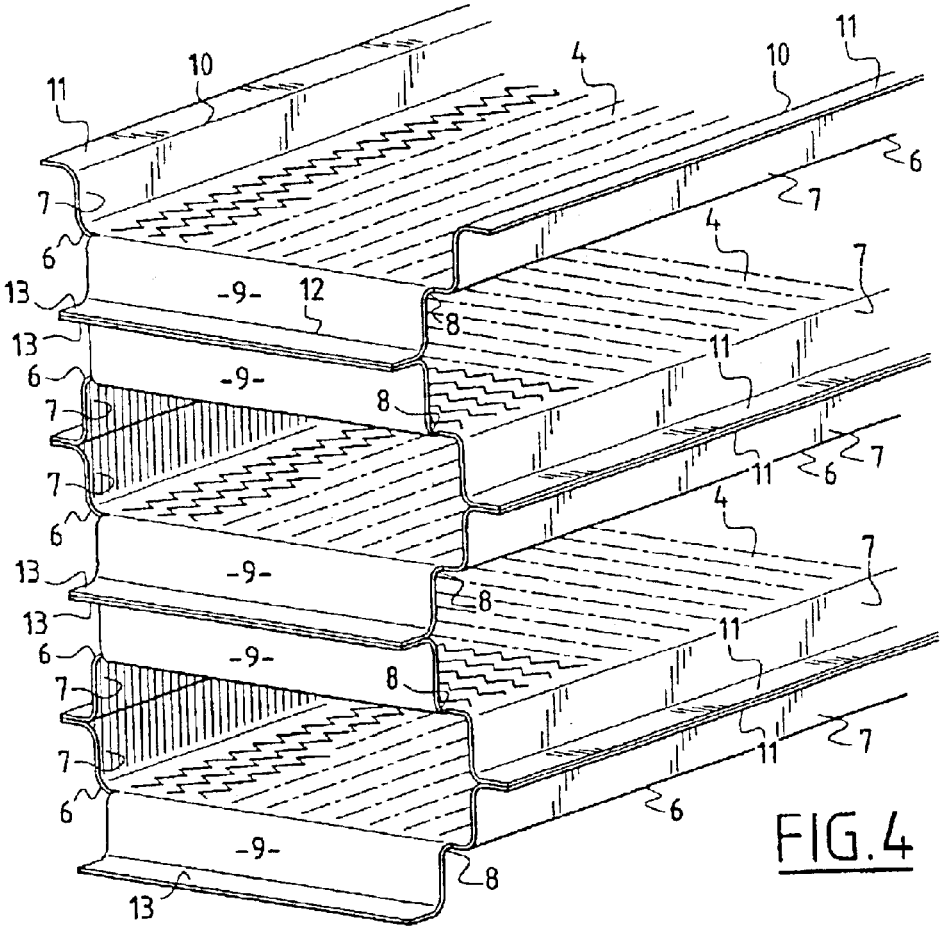

After having successively formed the first and second flanges 7, 9 and 11, 13 on each plate 1, these plates 1 are superposed on each other, as shown in FIG. 4, by applying the second flanges 11 and 13 of each plate 1 to the second flanges 11 and 13 of the adjacent plate.

Next, the plates 1 thus superimposed are held by suitable means (not shown).

Figure 5:
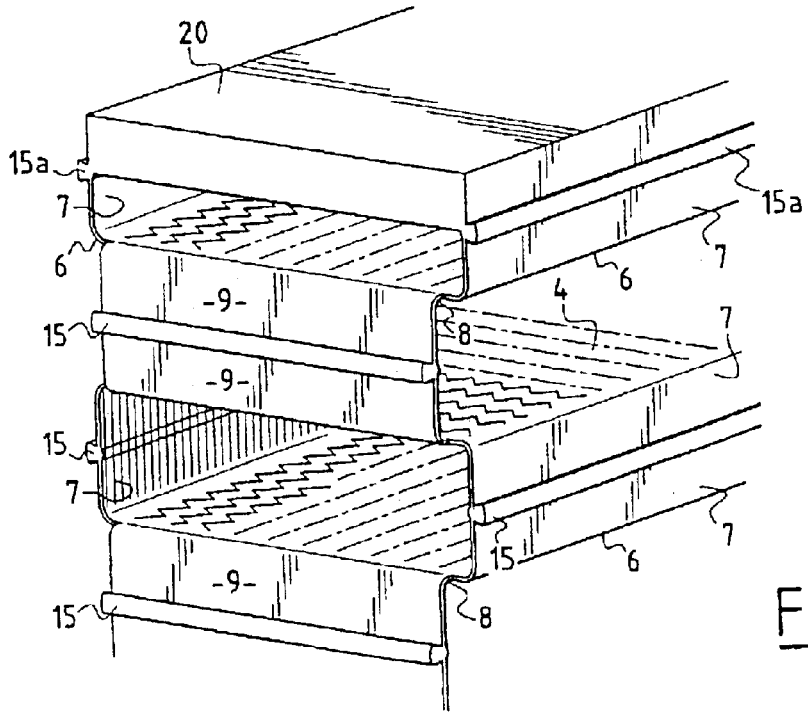

The plates 1 are fastened together by effecting a continuous and sealed weld bead 15, with or without filler metal, and by melting the second superposed flanges 11 and 13 of adjacent plates 1, as shown in FIG. 5. Preferably, the melting of the second flanges 11 and 13 is total.

Each weld bead 15 is obtained, for example, by the TIG method.

The second flanges 11 and 13 of each plate 1 form, with the first flanges 7 and 9, an angle equal to or different from the angle formed between the first flange 7 and 9 and the central part 4 of the said plate 1.

Each angle is preferably between 75 and 105° and, in the exemplary embodiment, this angle is equal to 90°.

Next, a closure plate 20 is placed on the upper part and the lower part, respectively, of the pack and each closure plate 20 is connected to the flange of the adjacent plate 1 by a continuous sealed weld bead 15*a*, as shown in FIG. 5.

In the embodiment shown in this figure, one of the fluids flows longitudinally in the plate pack and the other fluid flows transversely, thus making it possible to obtain a plate pack of the counterflow type. Each of the fluid inlet and outlet regions may be capped by a collector.

Figure 6:
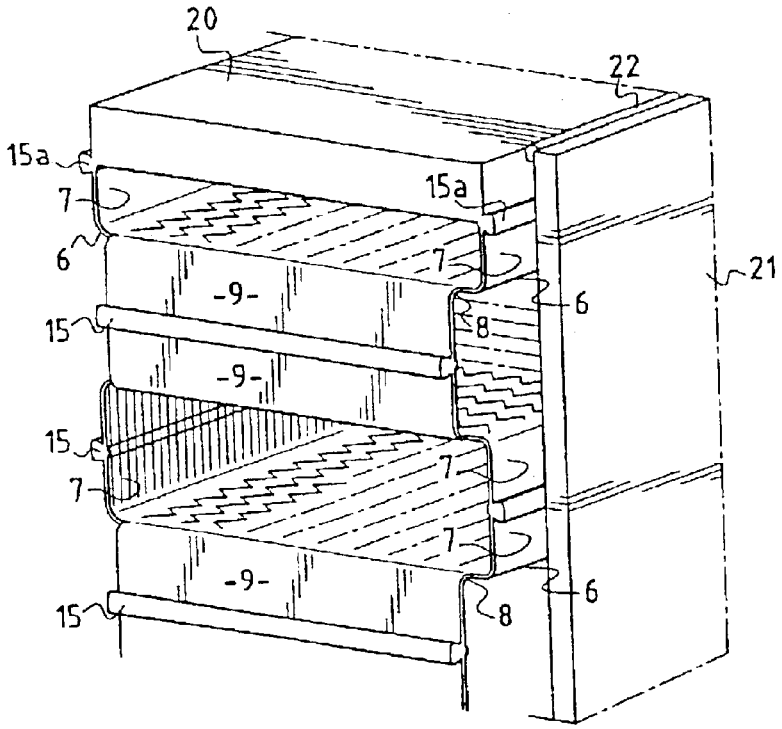

According to a variant shown in FIG. 6, the side faces of the plate pack are partly closed by a covering plate 21. Each covering plate 21 bears against the weld beads 15 connecting the first flanges 7 of the plates 1 and also on the longitudinal border of each closure plate 20.

Furthermore, each covering plate 21 is fastened to each closure plate 20 by means of a continuous sealed weld bead 22.

Thus, depending on the positioning of each covering plate 21, an inlet region A is made under each side face of the plate pack and an outlet region B is made on each of said side faces, away from the inlet regions.

Figure 7:
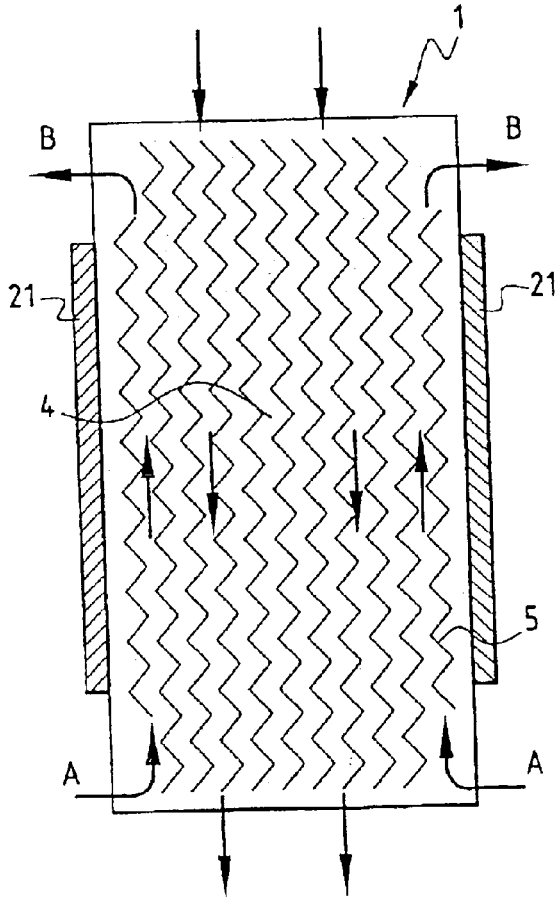
FIGS. 7 and 8 are schematic views in cross section showing examples of fluid flow in a plate pack assembled by the method according to the invention.

This arrangement shown in FIG. 7 makes it possible to obtain a counter-current flow of the two fluids in the plate pack.

Figure 8:
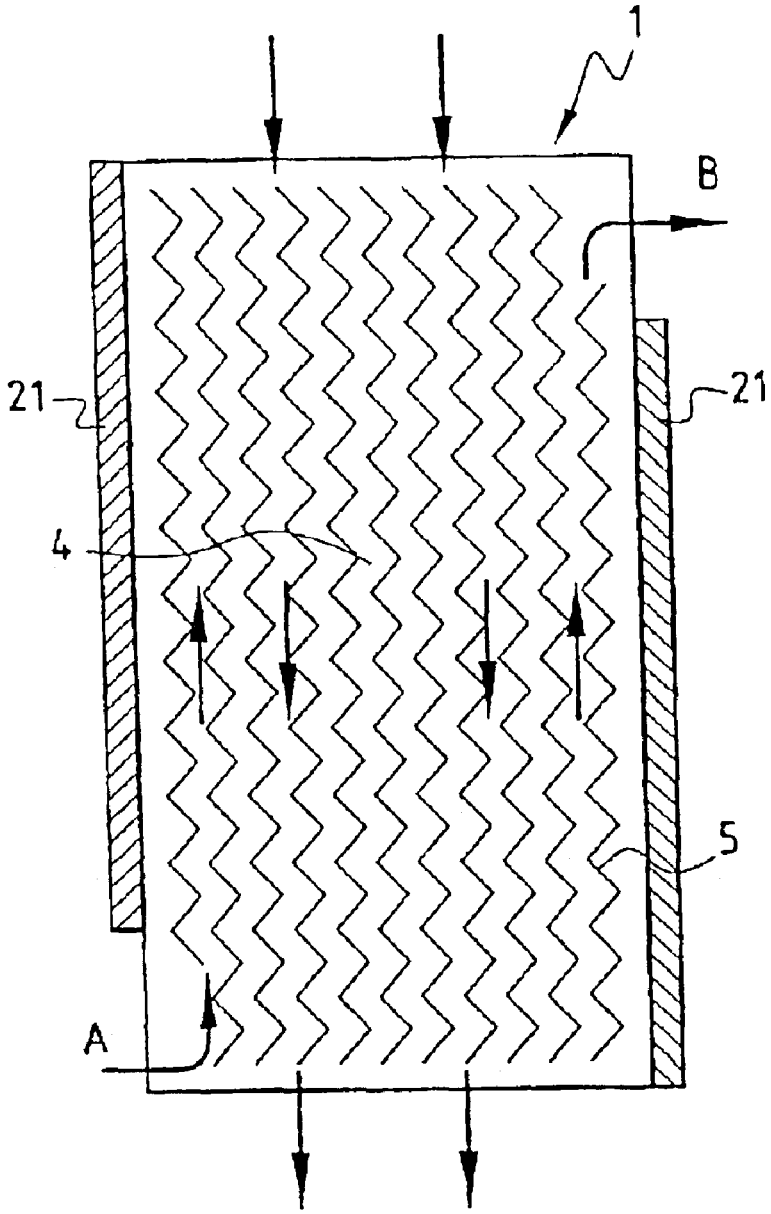

According to a variant shown in FIG. 8, a covering plate 21 is placed so as to form an inlet region A for a fluid on one side face of the plate pack and the other covering plate 21 is placed so as to form an outlet region B for said fluid, away from said inlet zone A.

With these various arrangements of the covering plates 21, it is also possible to obtain a co-current flow of fluid, by forming the fluid inlet regions at the same end of the plate pack.

The fluid inlet and outlet regions may also be capped by a collector.

Welding with or without filler metal and preferably by complete melting of the second flanges 11 and 13 then makes it possible to obtain an internal surface free from interstices and free from sites susceptible to corrosion.

The method of assembly according to the invention also has the advantage, by virtue of producing a double fold, of facilitating the operations of bringing the plates 1 into contact with each other and of having larger manufacturing tolerances than with methods of assembly used until now.

Furthermore, the method of assembly according to the invention makes it possible to obtain a better seal for the fluid flow circuits and a very strong mechanical bond which is able to accept relatively high differential pressures, which broadens the field of use of such a plate pack.

What is claimed is:

1. A method for assembling the plates of a plate pack for a heat exchanger formed by a stack of plates together defining at least two flow circuits for two independent fluids and each comprising a central heat-exchange part and borders with a smooth surface, comprising:

a cutout produced on corners of each plate;

on the border to be connected of each plate to the adjacent plate, a fold is made in order to form a first flange;

on this first flange, a fold is made in order to form a second flange lying parallel to the central part of the corresponding plate and directed outward from said plate;

the plates are superposed and held by applying the second flange of each plate to the second flange of the adjacent plate; and a continuous sealed weld bead is made by completely melting the second superposed flanges of adjacent plates.

2. The method as claimed in claim 1, wherein a closure plate is placed on the upper part and on the lower part, respectively, of the plate stack, and each closure plate is welded by a continuous sealed weld bead to the flange of the adjacent plate.

3. The method as claimed in claim 1, wherein each side face of the plate stack is partially closed by a covering plate.

4. The method as claimed in claim 1, wherein the second flange forms, with the first flange, an angle equal to or different from the angle formed between the first flange and the central part of the corresponding plate.

5. The method as claimed in claim 4 wherein each angle is between 75 and 105°.

6. The method as claimed in claim 1, wherein a closure plate is placed on the upper part and on the lower part, respectively, of the plate stack, and each closure plate is welded by a continuous sealed weld bead to the flange of the adjacent plate.

7. The method as claimed in claim 1, wherein each side face of the plate stack is partially closed by a covering plate.

8. The method as claimed in claim 2, wherein each side face of the plate stack is partially closed by a covering plate.

9. A plate pack for a heat exchanger, wherein plates superposed and assembled by the method according to any one of the preceding claims.

10. The plate pack as claimed in claim 9, wherein each plate has the shape of a quadrilateral comprising a central heat-exchange part and four borders with a smooth surface, each one fitted with a folded flange, the four folded flanges being directed alternately upward and downward.

11. The plate pack as claimed in claim 9, wherein a closure plate is placed on the upper part and on the lower part, respectively, of the plate stack, each closure plate being connected to the flange of the adjacent plate by a continuous scaled weld bead.

12. The plate pack as claimed in claim 9, wherein a covering plate is placed on each side face of the plate stack partially closing the corresponding side face.

13. The plate pack as claimed in claim 10, wherein a closure plate is placed on the upper part and on the lower part, respectively, of the plate stack, each closure plate being connected to the flange of the adjacent plate by a continuous scaled weld bead.

14. The plate pack as claimed in claim 10, wherein a covering plate is placed on each side face of the plate stack partially closing the corresponding side face.

15. The plate pack as claimed in claim 11, wherein a covering plate is placed on each side face of the plate stack partially closing the corresponding side face.

* * * * *